US005237906A

United States Patent [19]

Raymond

[11] Patent Number: 5,237,906

[45] Date of Patent: Aug. 24, 1993

[54] LINEAR FLUID POWER ACTUATOR ASSEMBLY

[76] Inventor: Robert E. Raymond, 495 Military Rd., Zanesville, Ohio 43071

[21] Appl. No.: 782,422

[22] Filed: Oct. 25, 1991

[51] Int. Cl.[5] ..... F01L 25/04

[52] U.S. Cl. ..... 91/291; 91/298; 91/320; 92/171.1

[58] Field of Search ..... 91/297, 298, 319, 320, 91/388, 291, 295; 92/169.4, 171.1

[56] References Cited

U.S. PATENT DOCUMENTS

| | | | |
|---|---|---|---|
| 364,081 | 5/1887 | Bates | 91/320 |
| 706,200 | 8/1902 | Quasebarth | 91/297 |
| 909,923 | 1/1909 | Mitchell | 91/297 |
| 2,069,122 | 1/1937 | Searle | 91/291 |
| 2,336,847 | 12/1943 | Couty | 91/320 |
| 2,799,444 | 7/1957 | Schemmel | 91/297 |
| 5,049,038 | 9/1991 | Weaver | 91/291 |

*Primary Examiner*—Edward K. Look
*Assistant Examiner*—F. Daniel Lopez
*Attorney, Agent, or Firm*—Francis T. Kremblas, Jr.

[57] ABSTRACT

An improved fluid power actuator assembly comprising a power piston reciprocatingly mounted in a cylinder bore which is formed in a compact fluid power manifold providing the necessary circuit connections between control valves mounted on the housing and the cylinder bore. The cylinder bore includes at least two circumferentially spaced signal ports disposed in the wall of the cylinder bore along the path of travel of the piston in addition to the primary power ports located at each end of the cylinder bore to drive the piston. The piston includes at least one circumferential groove and functions as a spool valve for opening and closing communication between the signal ports as the piston travels in the cylinder. Appropriate control valves and signal pressure communicating with the signal ports is disclosed to enable a fluid power signal to be generated which is related to the position of the piston during its travel in the cylinder bore. In turn, this signal is used to actuate appropriate control logic circuitry to reverse or modify the operation of the piston. Included in the control logic circuitry is a toggle type control valve which is actuated by a fluid pressure pulse to cause the main power flow control valve to switch power flow to reverse the direction of the piston stroke.

5 Claims, 7 Drawing Sheets

LINEAR FLUID POWER ACTUATOR ASSEMBLY

TECHNICAL FIELD

The present invention relates generally to fluid power apparatus and particularly to an improved fluid power linear actuator assembly.

BACKGROUND ART

Fluid power piston and cylinder assemblies are very old to actuate conventional working elements. Working element as used is defined as those types of machines or devices conventionally attached or coupled to and driven by a power cylinder or actuator to do major work and include pumps, fluid power presses, power lifts and excavators, for example. Various means and methods have been adopted to control the oscillating stroke of the piston, including reversal and modification of the speed of oscillation, for example. In general, a piston and cylinder assembly are connected to a fluid circuit including the necessary control valves which operate and/or modify the source of fluid power delivered to the cylinder at opposing ends of the piston. Such arrangements can become rather bulky and cumbersome, particularly when the control valve circuitry becomes relatively complex to provide more sophisticated control.

Prior attempts to sense the position of the piston in the cylinder during its path of travel have utilized complex electrical or mechanical switches alone or in combination to generate a signal to the control valve circuitry to reverse the piston stroke. Such arrangements do work, however, they tend to be quite complex and expensive to manufacture and are subject to mechanical failure particularly in applications wherein a high number of cycles is involved.

Prior to the present invention, a satisfactory fluid power sensing and signaling control arrangement, as compared to the prior mechanical or electrical types, has not been developed which accurately and reliably is related to and actuated by the position of the piston in the cylinder during its stroke. Nor has the prior art taught a hydraulic actuator of this type which can be advantageously incorporated into a manifold housing wherein most or all of the fluid circuit connections can be compactly arranged around the cylinder bore which is formed by a central bore in the manifold housing, which housing also serves as a convenient mounting surface for various control valves.

SUMMARY OF THE INVENTION

The present invention relates generally to an improved fluid power actuator and particularly to a novel piston and cylinder arrangement wherein the piston functions not only to perform its typical work, but additionally functions as a control valve element which senses the position of the piston in the cylinder during its stroke and may be used to generate a fluid power pilot signal related to its own position.

More particularly, a fluid power actuator assembly is disclosed wherein the piston is mounted in a cylinder bore formed in a manifold housing of the type generally disclosed in my earlier U.S. Pat. No. 4,011,887 to create a compact assembly accommodating all necessary circuit interconnections and providing convenient mounting of the desired valve bodies used to control the operation of the piston.

Further, a novel fluid circuit arrangement is disclosed wherein a pulsed control pressure signal related to the piston's displacement in the cylinder is employed to trigger a reversing valve which functions as a lock-in or toggle relay and provides a sustained signal pressure which may be communicated to operative power valving elements to reverse or otherwise modify the piston stroke. The pulse pilot or control pressure signal is created by the piston acting as a signal valve in cooperation with ports disposed in the cylinder side wall.

As one aspect of the present invention a power cylinder and piston arrangement incorporating circumferential piston grooves communicating selected side wall ports circumferentially spaced from one another and disposed at selected axial locations in the cylinder wall provide a signal pressure pulse to sense piston position and actuate reversal of the piston stroke in a reliable manner.

In another embodiment the cylinder pilot ports are similarly used to provide a pulse signal to initiate deceleration of the piston during its forward and/or reverse stroke.

As another aspect of the present invention, a novel arrangement of a piston disposed in a cylinder bore which is formed within a compact manifold housing which includes all the necessary circuit interconnections for control valves conveniently mounted on the housing is provided to conveniently and efficiently provide a very compact and efficient package compared to the prior art.

As a further aspect of the present invention, a piston and cylinder arrangement is provided wherein the piston performs its typical oscillating work and also incorporates grooves which communicate with circumferentially spaced signal pressure ports in the cylinder side walls to function as a signal valve sensing selected piston displacement within the cylinder. This provides a fluid power sensing of the piston's position in the bore for actuating control functions in a relatively simple and economical form. In one preferred embodiment, the piston, acted upon at each end by high pressure to do reciprocating work, also acts as a reversing signal valve providing a pulse signal which triggers a reversing valve logic circuit to switch the high pressure source to the opposing end of the piston.

In a more preferred embodiment, the above features are combined to provide a very compact fluid power actuator package including necessary fluid circuit interconnections incorporated in a manifold housing having the cylinder bore and piston mounted within the housing to perform reliable, self-sustained, reversing control of the reciprocating piston in addition to other control functions of the piston's power strokes.

It is therefore a primary object of the present invention to provide a fluid power actuator which also functions as a fluid power signal valve to sense and initiate control functions of its reciprocating stroke.

It is another object of the present invention to provide an actuator apparatus of the type described which cooperates with a novel lock-in or toggle type fluid power control valve in a reversal logic circuit which is actuated by a pulsed signal related to the position of the piston in the cylinder bore.

It is a further object of the present invention to provide a hydraulic actuator of the type described which is housed within a fluid power control manifold which includes the necessary fluid passages interconnecting the actuator power ports to all control valve functions in a highly compact, efficient manner.

Figure 1:
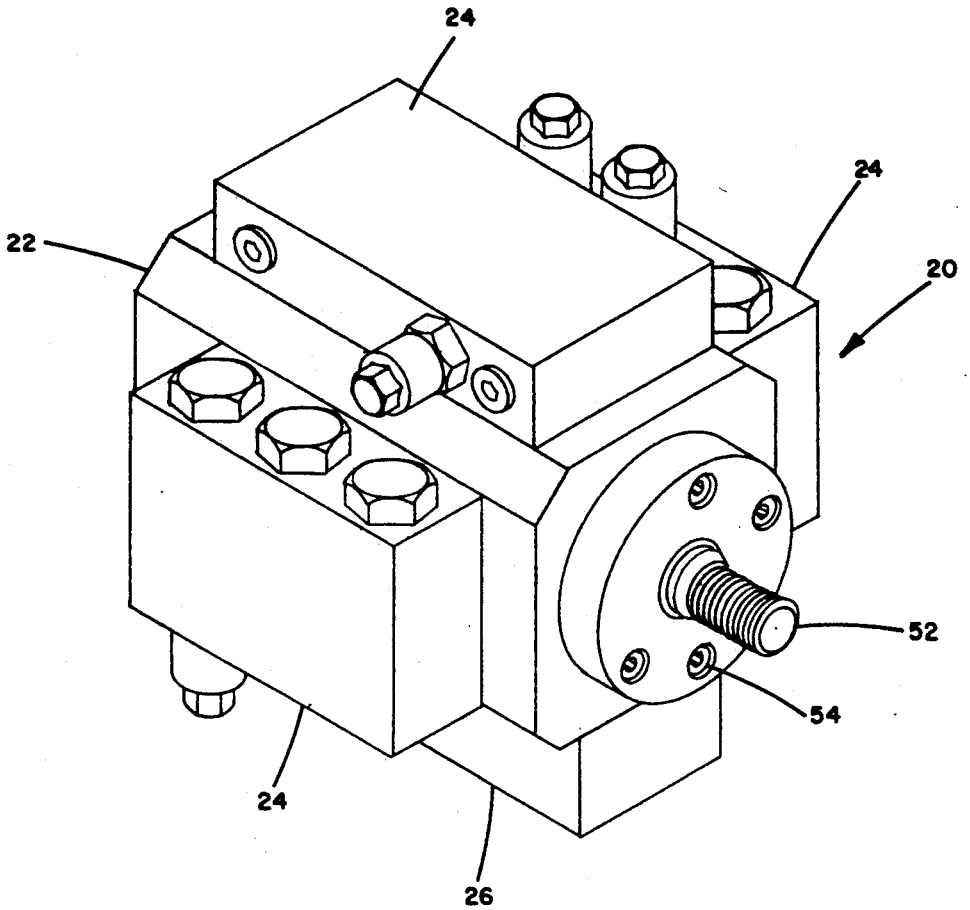
FIG. 1 is a perspective view of a preferred embodiment of a hydraulic actuator apparatus constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF PREFERRED EMBODIMENT

Figure 2:
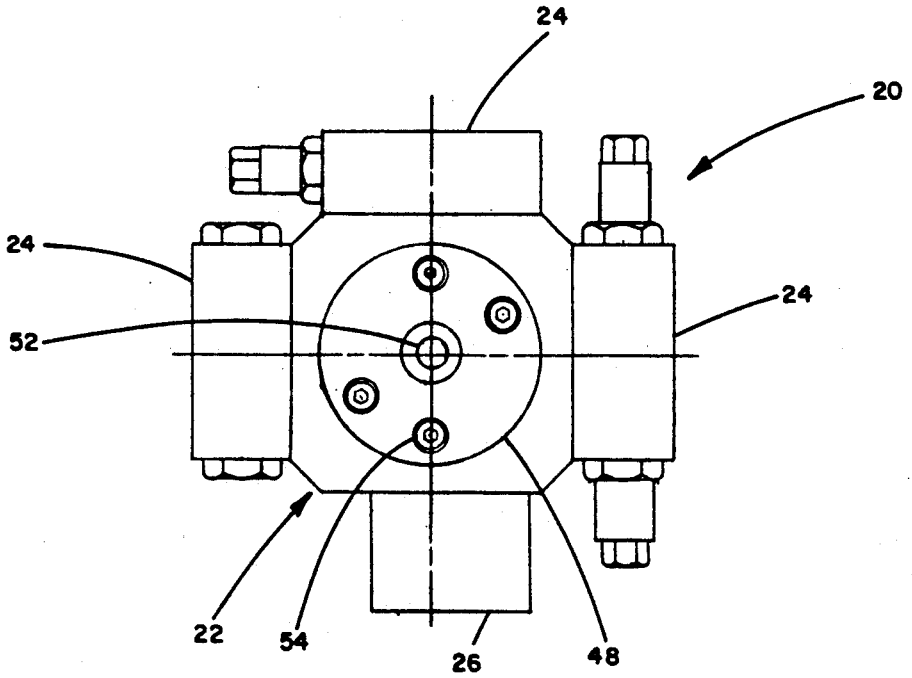
FIG. 2 is a right end elevational view of the apparatus shown in FIG. 1.
Figure 3:
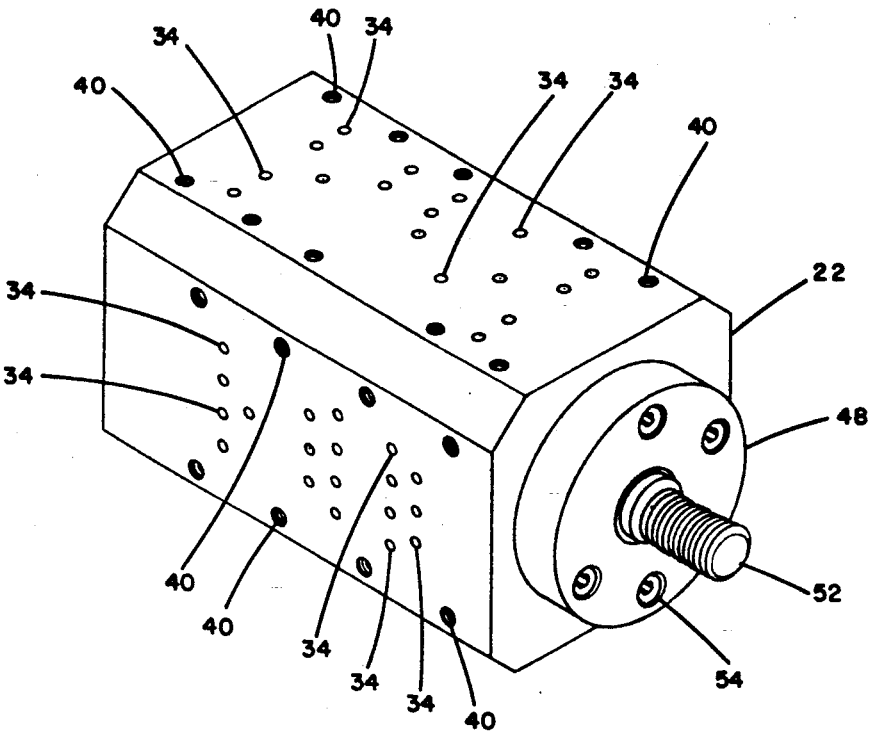
FIG. 3 is a perspective view of a portion of the apparatus shown in the preceding Figures illustrating the manifold housing without the control valves mounted thereon.

A hydraulic actuator assembly, indicated generally at 20, constructed in accordance with the present, is shown in FIGS. 1 and 2 and includes a manifold housing indicated generally at 22 carrying a plurality of control valves 24 mounted to the outer surface of housing 22. An inlet port plate or block 26 is mounted to the bottom of housing 22 and preferably includes inlet and outlet ports as required for connection to a conventional supply of fluid power, not shown. Preferably, manifold housing 22 comprises an outer receptacle member 27 and a central core member 28 interferringly fit, preferably by heat shrinking into a cylindrical bore 29 provided in receptacle member 27 such as shown in FIGS. 3 and 4.

The construction of manifold housing 22 including core member 28 is preferably in accordance with that disclosed in my prior U.S. Pat. No. 4,011,887 wherein the outer surface of the core member 28 is provided with a plurality of circumferentially and axially extending grooves such as 30 and 32, and a plurality of radial passages such as 34, for example. The disclosure of U.S. Pat. No. 4,011,887 is incorporated by reference herein.

As described in my prior patent referred to above herein, core member 28 is shrunk into a central bore within member 27 such that the fluid passages formed by grooves 30 and 32 and radial passages 34 form discrete fluid pathways between the inner surface of the bore and the outer surface of core 28 for interconnecting various fluid power elements to one another in a selected fluid circuit configuration to accomplish fluid power control.

Figure 4:
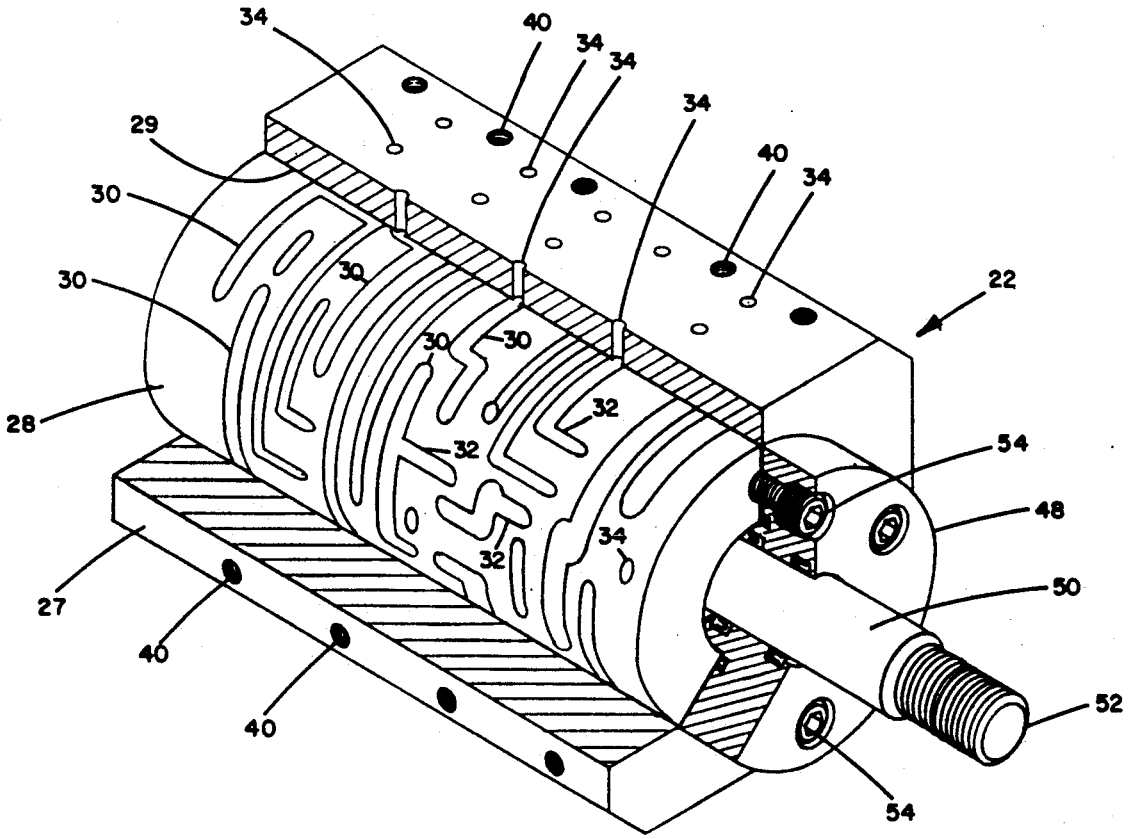
FIG. 4 is a perspective view similar to that shown in FIG. 3 with a portion of the outer receptacle member of the manifold housing shown cut away to expose the fluid passages provided on the inner core member.

As seen in FIG. 4 the grooves 30 and 32 and radial passages 34 are merely representative of how fluid passages are formed and do not necessarily represent specific interconnections for a fluid circuit design such as described later herein.

As seen in FIG. 3, outer receptacle member 27 also includes a plurality of radial passages, such as 34, which are disposed to align with inlet and outlet ports in control valves 24 to communicate with the fluid circuit passages formed by grooves 30 and 32 and radial passages 34 provided in the manifold 22.

A plurality of threaded holes, such as 40, are provided on the outer surface of housing 22 for conventional mounting of various valve bodies 24. Valve bodies 24 may be conventional ANSI valves well known in the art, or may be any other form including conventional spool valve cartridges mounted in a conventional or custom made valve sleeve arrangement housed in the block-like bodies 24, as shown, to provide the desired fluid power control functions. The most compact valve arrangement which can be economically manufactured is preferred, however, the particular choice of control valve packages 24 employed is a matter of design choice and by itself forms no part of the present invention.

Figure 5:
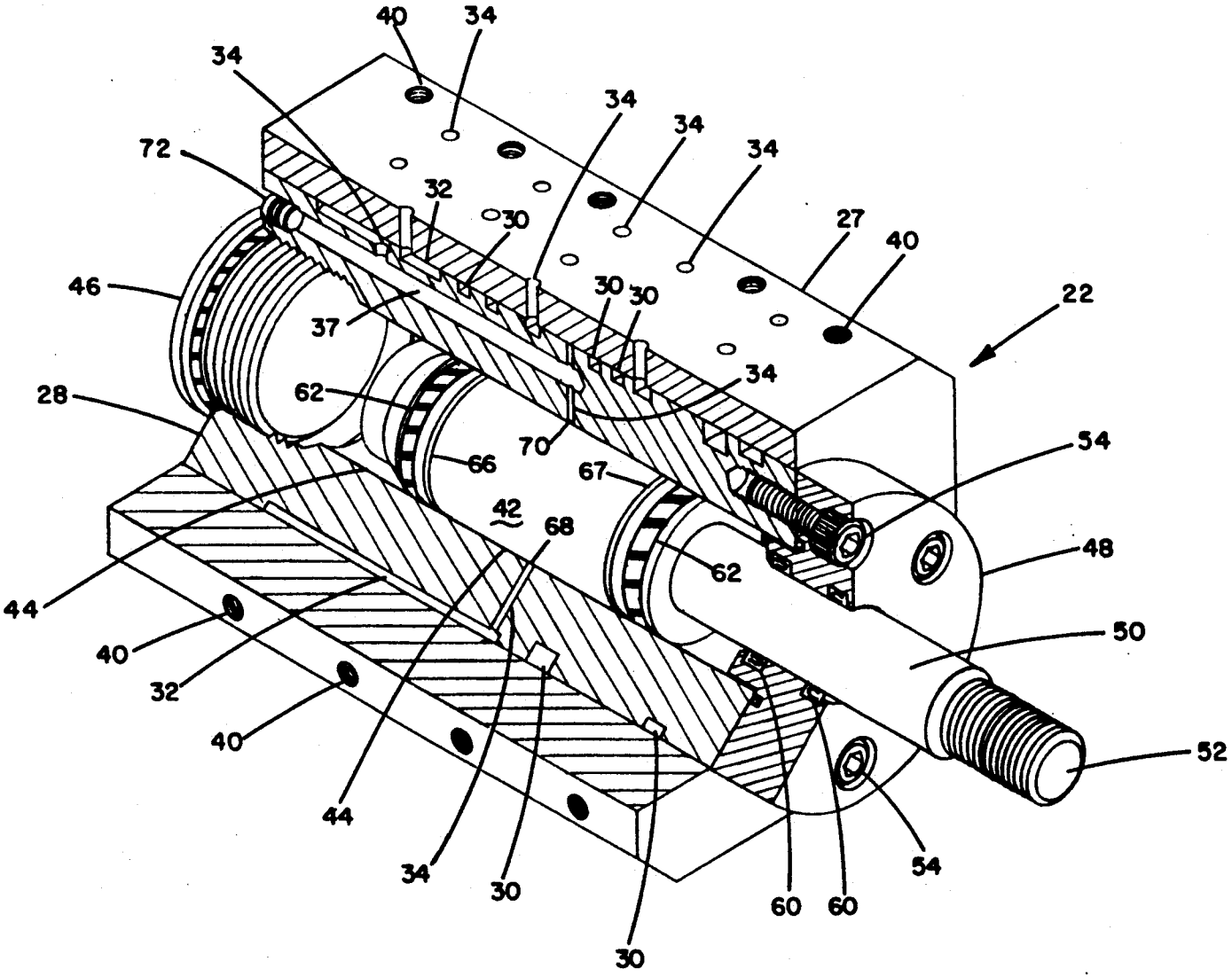
FIG. 5 is a perspective view similar to that shown in FIGS. 3 and 4 with a further portion cut away through the core member to expose the piston reciprocally mounted through a cylinder bore provided in the core member.
Figure 6:
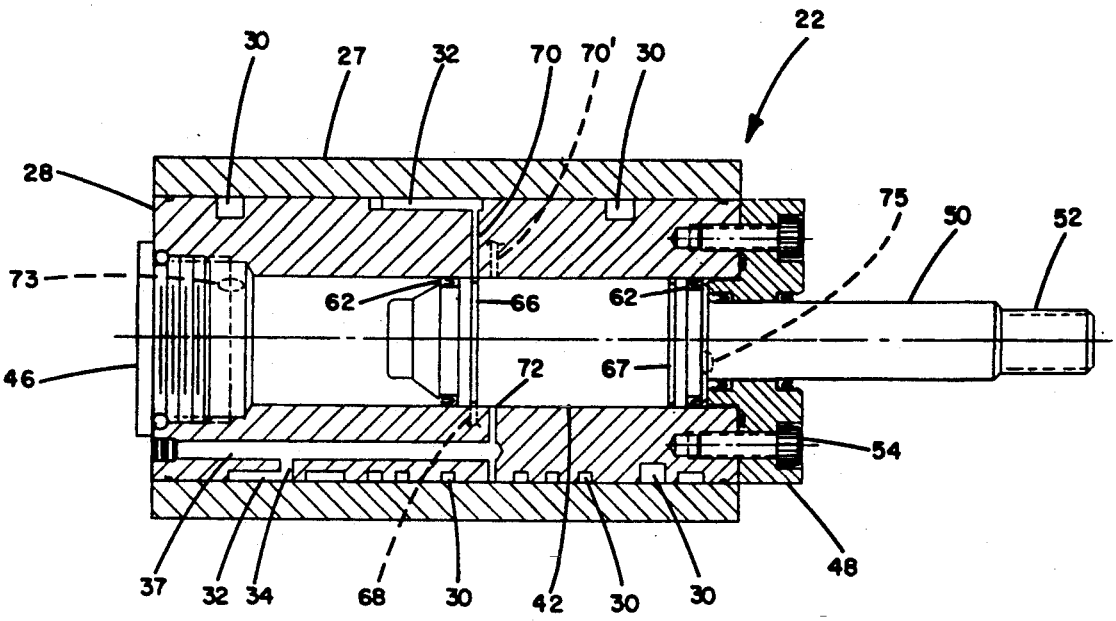
FIGS. 6 and 7 are side elevational views in section of a portion of the apparatus shown in FIG. 1, the control valves being removed, illustrating the position of the piston at each end of its oscillating stroke and the relationship of the grooves on the piston with certain pilot control ports located in the cylinder bore wall.
Figure 7:
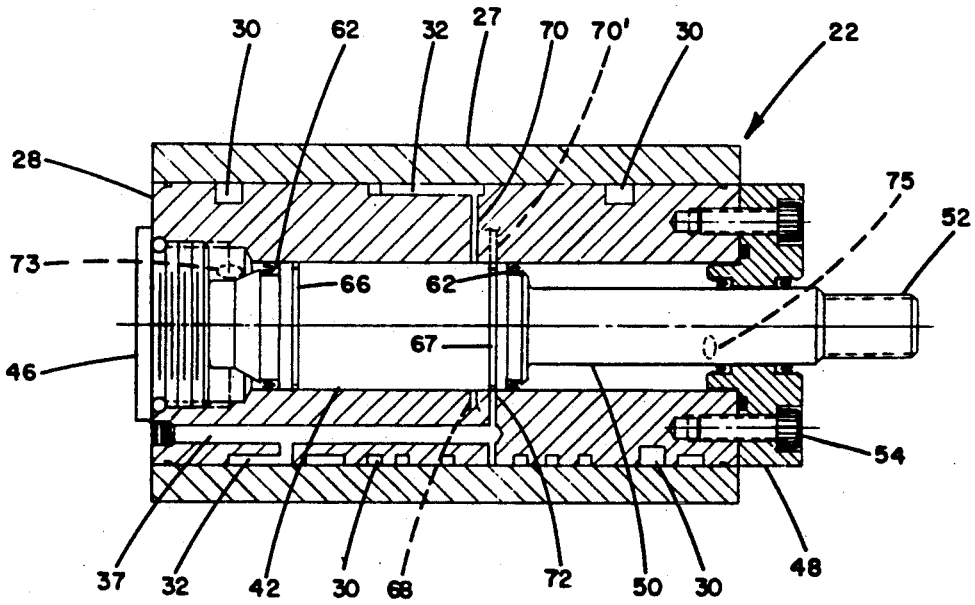

Referring now to FIGS. 5–7, a power piston 42 is slidable mounted in a close-fit relationship within a cylindrical bore 44 which is provided through the center of core member 28. Cylinder bore 44 is suitably closed by end cap 46 threadably received in an enlarged and threaded end portion of cylinder bore 44 and end cap 48, through which the piston rod 50 of piston 42 extends. End cap 48 is bolted to housing 22 in a conventional manner via bolts 54, however, other suitable means for fixing the end caps may be used.

The outer end 52 of piston rod 50 is threaded to appropriately receive for example, the rod end of another cylinder for a pump or other type of operative element. However other conventional and well-known coupling means may be employed. For example, piston 42 may function as a linear actuator to operate another fluid operated pump to control the pump stroke in relationship to the controlled oscillations of the actuator piston 42.

Still referring to FIG. 5, conventional shaft seals 60 are provided to prevent significant leakage of high pressure along rod 50. Piston 42 carries conventional seals 62 mounted on and disposed near each end of piston 42 to isolate the high pressure alternately introduced into one of the main power ports at each end of cylinder bore 44 from the opposing ends and the intermediate head area of the piston 42. In some cases the return stroke of the piston requires only a relatively low pressure compared to that driving the power stroke, than only one mounted seal may be used as the clearance seal formed between the close fit piston and cylinder may be adequate at one end of the piston to prevent excessive leakage from that inlet power port.

As seen in FIG. 5, a pair of axially spaced grooves 66 and 67 are provided on the surface of piston 42 between the seals 62. In the section shown in FIG. 5, two of four control pressure pilot ports 68 and 70 are shown. The other two pilot ports are circumferentially spaced and are not seen in FIG. 5. For purposes of balancing pressure, it is preferred to locate a similar pilot pressure port 180 degrees removed from one another to equalize pressure on piston 42 which acts as a spool valve element so as not to introduce significant unbalanced side forces acting on the piston.

Ports 68 and 70 and any other pilot ports used in a similar manner are communicated to the appropriate passage connection within the fluid circuit design by one of the grooves 30 or 32. Alternatively, one could employ an axial passage, such as seen at 37, which in turn can be communicated to one or more grooves 32 via radial passages 34. Axial passage 37 is merely drilled into core member 28 from one end and conventionally plugged by a threaded member 72.

The particular choice and location of grooves 30 or 32 and radial passages 34 or axial passage 27 is a matter of design choice to efficiently create the necessary circuit interconnection between operative fluid power control and power elements.

Now referring specifically to FIGS. 6 and 7, piston 42 is shown at the end of its forward and reverse stroke in connection with illustrating the relationship of piston grooves 66 and 67 with pilot ports 68, 70, 70' and 72. As seen in FIGS. 6 and 7, pilot port 70 communicates with a source of pilot pressure, typically relatively low pressure of 150 psi for example, which is preferred to operate fluid pilot control elements. The control port 70 and its counterpart 70' will always carry this control pressure and are respectively aligned in circumferential relationship to pilot ports 68 and 70 which are axially spaced from one another. Therefore as piston 42 moves to the right as seen in FIG. 6, port 70 communicates control pressure via piston groove 66 to pilot port 68. Conversely, as piston 42 moves to the left in the retracted position seen in FIG. 7, pilot control port 70, carrying control pressure is communicated to pilot port 72 via piston groove 67.

Figure 9:
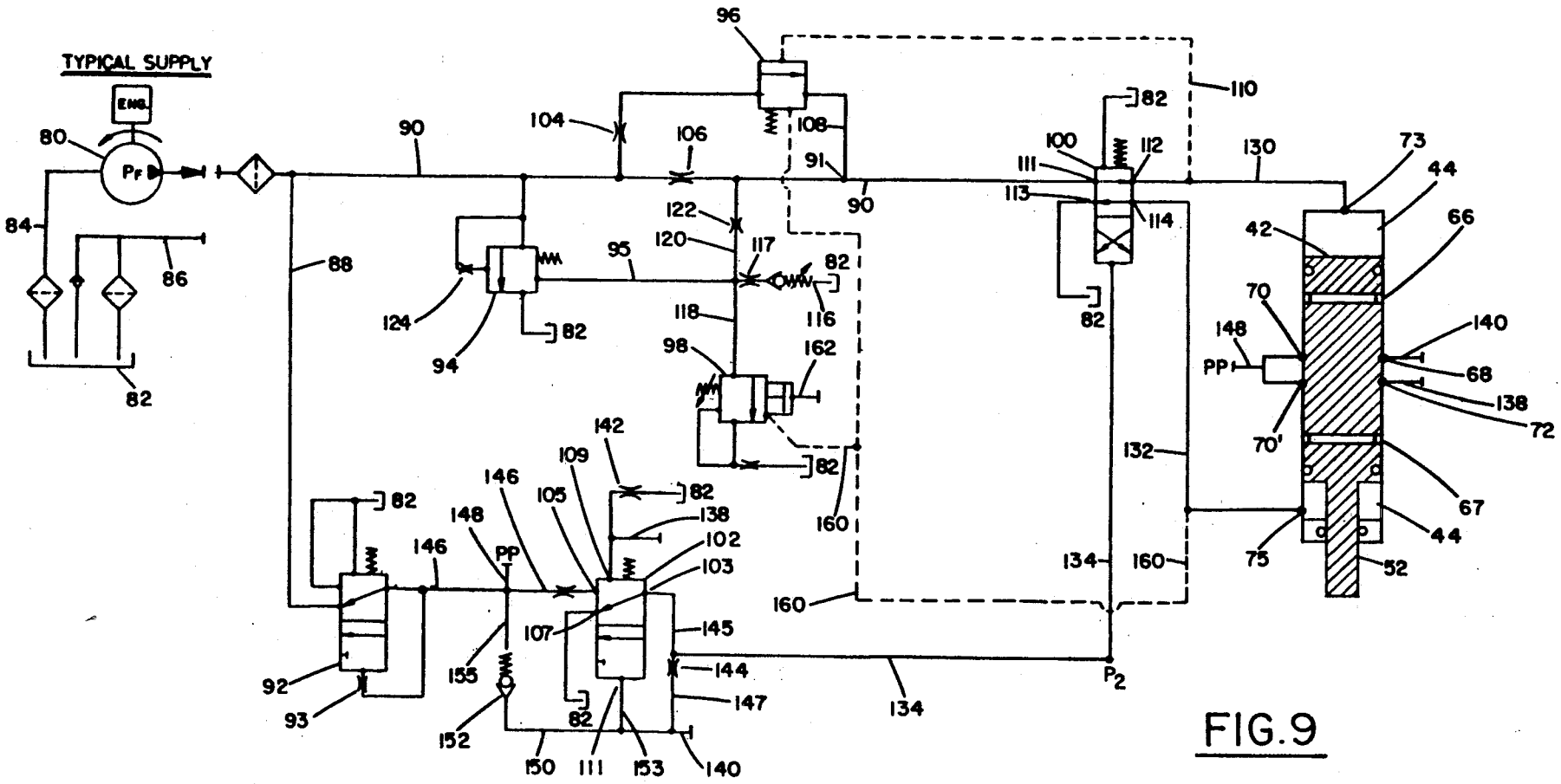
FIG. 9 is a schematic view showing a fluid circuit for a preferred embodiment of the present invention which includes a novel toggle type, fluid power relay circuit logic to initiate reversal of the piston stroke.
Figure 10:
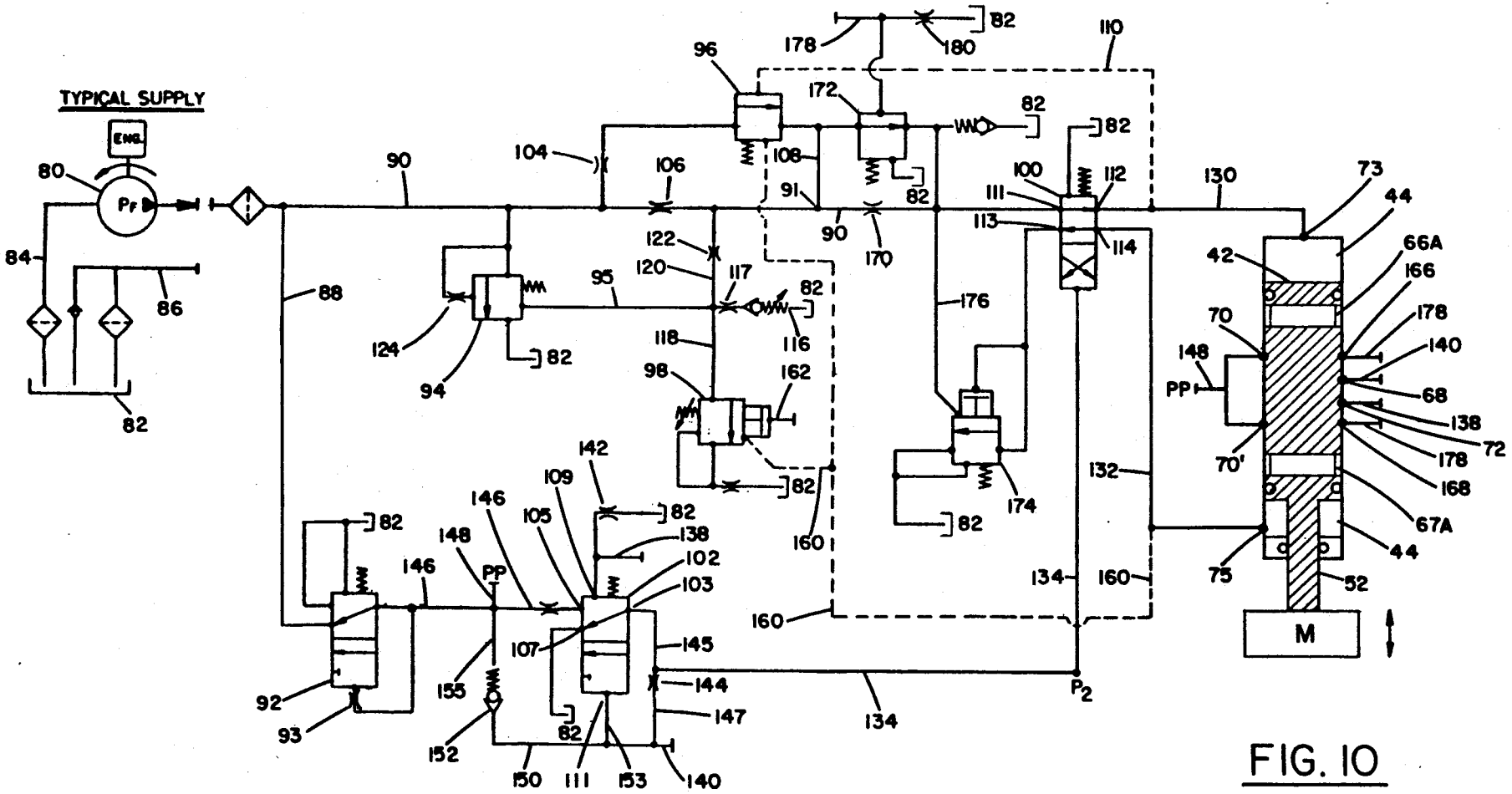
FIG. 10 is another schematic view of a fluid circuit for another embodiment of the present invention illustrating a deceleration function added to the circuit illustrated in FIG. 9.

When a given pilot port 68 or 72 is aligned with a respective one of the pilot ports 70 or 70', a control pressure pulse is generated to the fluid circuitry at its interconnection with the port 68 and 72. The operation of the control logic of the fluid circuit will be described in detail as shown in FIGS. 9 and 10. However, upon appropriate location of grooves 66 and 67 on piston 42 and pilot ports 68, 70, 70' and 72; fluid pressure control signals related to the position of piston 42 during its forward or its reverse stroke can be generated to actuate appropriate control valves to act upon the control valve logic of the high pressure delivered to each end of piston 42 to reverse or otherwise modify the piston stroke.

As will be described in detail later herein, the alignment of control pressure ports 70 or 70' with one of the pilot ports 68 or 72 will be quickly broken as the pulse signal generated will trigger the hydraulic circuit logic to cause the piston to reverse its direction as shown in the embodiment of FIGS. 6 and 7.

As seen in FIGS. 6, the piston 42 has reached is fully extended stroke driving rod 50 outwardly to the right. In this position, the pressure control ports 70 is aligned with groove 66 near the left end of piston 42 to communicate pilot pressure port 70 with control port 72. In FIG. 7, piston 42 is shown in its opposite, fully retracted stroke with pilot pressure port 70' aligned with groove 67 disposed near the right end of piston 42 to communicate port 70' to control port 68. When the pilot pressure present in ports 70 and 70' is communicated to one of the control ports 68 or 72, a pressure signal is generated which is communicated to the hydraulic circuitry formed in housing 22 via appropriate fluid passages formed by radial bores 34 and the grooves 30 and 32 or, if desired, axial passages such as 37. The specific description of the hydraulic control functions will be fully described as shown in FIGS. 9 and 10. However, it should be understood that by appropriate location of grooves such as 66 and 67 and ports such as 70, 70', 68 and 72, piston 42 functions as a control valve element in addition to a power driving piston, and generates a pressure signal related to its position during travel of its extended and retracted strokes.

The main cylinder bore ports 73 and 75, through with high pressure enters and exits from the piston head and rod sides of cylinder bore 44, are provided through suitable radial bores in outer receptacle 27 and core 28.

Therefore, this pressure signal which is directly related to piston position permits control functions to be actuated solely by fluid power elements and eliminates the need for limit switches and the like conventionally used in the prior art. This pressure signal generated may be communicated to other fluid control elements in a variety of control or indicator logic circuits which can be very advantageously used to control or modify the pistons stroke, for example. In the preferred embodiment shown, piston 42 functions as its own reversing valve element. In another example, shown in FIG. 8 and FIG. 10, a deceleration function is shown and described wherein both stroke reversal and deceleration of the piston near the end of its stroke is effected.

These control functions are very efficiently accomplished when the piston is housed or encapsulated within the housing 22 wherein all fluid circuit interconnections can be made via the radial bores 34 and grooves 30 and 32. Further, a very compact package is realized which can be manufactured in an efficient and relatively inexpensive manner.

With reference to FIG. 9, a preferred hydraulic circuit for the controlling piston 42 in an oscillating mode is diagrammatically illustrated which includes a novel toggle-type or lock-in relay valve which is actuated by the pressure signal generated by piston 42 as its reaches the end of its stroke.

As shown in FIG. 9, a conventional supply of fluid power is provided by pump 80 which may be driven by any form of conventional driving means. Pump 80 and associated system is conventionally communicated to tank 82 via lines 84 and 86. The high pressure outlet of pump 80 is communicated to lines 88 and 90 which form part of the fluid control circuit for piston 42.

A small portion of the power flow of pump 80 is directed to a reducing valve means 92 to generate a pilot pressure supply of 150 psi, for example, to operate the pilot control functions. The remaining high pressure supply is directed to the power control valves 94, 96, 98, 100 and 116 which operate to control the direction, flow and pressure functions to accomplish automatic oscillation of piston 42 in a conventional manner.

With reference to valve means 92, it is a normally open reducing valve. As the high pressure from line 88 goes through the valve, a portion representing the pilot pressure is fed back through damping orifice 93 to move the spool to closed position.

The conventional bias spring sets the desired pilot pressure level, 150 psi, for example, and at that setting the valve will tend to close and modulate to hold the 150 psi selected setting irrespective of the high pressure in line 88 coming from pump 80 within practical limits, for example between 250 and 2000 psi.

As the pilot control valve 102 in the sensing and reversing circuit requires flow at 150 psi to supply orificing and control pressure, valve means 92 modulates open sufficiently to provide the required amount at the set pressure. Of course, if desired, a separate low pressure pump could supply the desired pilot control pressure as is well-known to those skilled in the art.

Referring now to valve means 94 and 96, a bi-level fluid control arrangement is shown which is basically a bypass flow regulating circuit having two orifice settings that are automatically determined pursuant to the piston being in its power stroke or its return stroke. It merely represents an optional speed control of the piston which is desirable in certain applications.

Orifices 104 and 106 are in parallel if valve 96 is open and orifice 104 is blocked if valve 96 is closed. When valve 96 is closed, only flow through orifice 106 feeds cylinder 44 through four-way valve 100.

The main pressure in line 90 from supply pump 80 minus the pressure at the back side of valve 96 at the junction 91 of line 108 and 90 is across valve 94 and against its bias spring pressure setting, 75 psi for example. Therefore a pressure drop across orifice 106 is held at 75 psi and any condition which tends to cause the pressure to rise will result in a bypass flow through valve 94. If the pressure should fall, then valve 94 closes which delivers a bypass flow back through orifice 106. In other words, a constant flow is held across orifice 106 if the pressure at junction 91 is essentially equal to the pressure in line 95 on the outlet side of valve 94. A static feedback line 120 through orifice 122 provide that the pressure in line 95 is essentially equal to the pressure at junction 91. Valve 94 is essentially a patch across orifice 106. In this condition, both orifices 104 and 106 are open to valve 100 to feed the cylinder 44.

A feedback line 110 is communicated to valve 96 opposing a bias spring having a 50 psi equivalent force, for example. Starting with the piston 42 in a fully retracted or up position, when piston 42 start moving outwardly against pressure, the pressure at valve port 112 is fed back to valve 96 through line 110 since the pressure at port 114 would be to tank 82. Therefore a sizable pressure drop occurs across valve 96 which causes it to open and puts orifices 104 and 106 in parallel to deliver a higher flow through valve 100 to main cylinder port 73 at the same 75 psi pressure drop determined by valve 94 when a lower flow occurs only through orifice 106 when valve 96 is closed.

In the situation when the four-way valve is reversed and the flow through valve port 112 is to tank and flow goes through valve port 114 to main cylinder port 75, valve 96 is vented to tank through line 110 and closes. Then flow occurs only through orifice 106 to main cylinder port 75.

One can therefore, by selection of appropriate orifices, provide for matched flow in either direction or higher flow in one direction to modify the speed of the piston stroke. This circuitry basically provides a bypass, pressure compensated, flow control with two orifice commands determined by a feedback signal to deliver a selected flow to each end of the power cylinder. Regardless of a change in inlet supply pressure, the circuit will hold the set flows.

The control of pressure to the power side of the circuit can be accomplished in a variety of well-known manners. In the circuit shown in FIG. 9, the pressure control functions are determined by a poppet valve pilot valve 116 and a multiple pilot input valve 98. Both of these elements communicate with the junction 117 of lines 118, 120 and 95. If they conduct fluid flow because the pressure has reached a selected set point, that flow goes through orifice 122 causing a drop in the pressure at junction 117 compared to the pressure present at junction 91 and, of course, in line 90. This pressure drop causes valve 94 to respond accordingly as determined by the settings of pressure pilots 116 and 98. In this instance, orifice 122 functions as a pilot flow control orifice rather than a static damping feedback orifice whenever pilot valves 98 and 116 are activated. In its normal operation, valve 94 will hold its set flow control until pilot valves 116 and 98 are activated at their set points and then valve 98 and its circuitry including orifices 122 and 124 function as a relief valve in a conventional, well-known manner.

Up to this point, the circuitry described is basically conventional to provide typical flow and pressure control of the power supply to the cylinder 44 and piston 42. With continued reference to FIG. 9, the novel reversing logic circuitry will be described in connection with the embodiment shown wherein piston 42 functions as a fluid power element to do work in a conventional sense. Seals 62 at each end of the head of piston 42 isolate the center portion from the high pressure introduced alternately to main cylinder ports 73 and 75. The center portion of piston 42 is provided with grooves 66 and 67 and the wall of cylinder 44 is provided with pilot ports 68, 70, 70' and 72 as earlier described.

When piston 42 is in the retracted position shown in FIG. 7, four-way valve 100 connects cylinder port 73 to high pressure via line 130 and cylinder port 75 to tank via line 132. Valve 100 is biased in this position via a conventional bias spring of appropriate force and switched to a reverse position by a pilot pressure introduced through line 134. If the pressure in line 134 is zero or any value less than the force of the bias spring, valve 100 permits the pressure supply to flow into port 73. If the pressure in line 134 is greater than the bias spring force holding valve 100 in this position, valve 100 switches the pressure flow to port 75 and connects port 73 to tank.

In the retracted piston position, groove 66 is isolated from the pilot ports in the wall of cylinder 44. However, groove 67 is aligned to communicate pilot pressure port 70' with pilot control port 72. In the embodiment shown, for a reversing function, the grooves are located near each end of the head of piston 42 and the pilot ports are disposed near the midline since the head of piston 42 is approximately equal to the length of its stroke. However, location of the grooves on piston 42 relative to the location of the pilot ports in the cylinder wall may be varied as desired to obtain a signal pressure related to the position of the piston for any particular useful application.

However, when ports 70' and 72 are aligned as shown in FIG. 7, the pilot pressure present in port 70' is then communicated to reversing control valve 102 via line 138.

In the opposite case, as seen in FIG. 6, groove 66 is aligned to communicate pilot pressure port 70 to pilot control port 68. The pilot pressure in port 70 is then communicated to reversing control valve 102 via line 140.

Therefore, it should be understood that only when piston 42 reaches the end of its oscillating stroke are pilot signals generated in the embodiment shown in FIG. 9. As the piston moves toward the opposing end, grooves 66 and 67 are not aligned with any of the pilot ports in the cylinder wall and no pilot signal is generated until the piston reaches the end of its stroke. Further, since the pilot pressure signals generated when either groove 66 or 67 is aligned with the above-described pilot ports are broken as the piston 42 moves toward the opposing end, the signals generated are pulses. However, the three-way reversing valve 102 and its associated circuitry lock-in the pilot pressure signals received and communicate the same pilot pressure to four-way valve 100 in a novel manner as described below.

As seen in FIG. 9, valve 102 functions as a three-way reversing logic control valve which supplies line 134 with a pressure signal indicated as $P_2$. Valve 102 is a conventional two position spool valve which alternately connects a control port 103 to an inlet pilot pressure port 105 or to tank return port 107 which define two operative states in the line 134 connected to control port 103, that is, zero pressure and a fully operative pilot pressure which is operative on valve 100. Pilot pressure ports 109 and 111 are communicated to opposing ends of the spool valve of 102 to effect shifting of the spool from one state to the other. In the retracted piston position shown in FIG. 7, $P_2$ is vented to tank through valve 102 by a conventional bias spring force on the upper side of valve 102. Orifices 142 and 144 are control orifices through which lines 138 and 140 are connected to tank dependent upon receiving a respective one of pilot signals from pilot ports in cylinder 44.

When a pilot pressure signal is present in either line 138 or line 140, the respective orifices 142 and 144 prevent the pilot pressure from shorting directly to tank. While an insignificant flow can bleed to tank, the essentially full pilot pressure is directed to a respective end of the spool of valve 102 as each orifice acts as a high resistance to the flow of pilot pressure to tank.

In the retracted position, the pilot pressure in line 138, which occurs when port 70, is communicated to port 72, is imposed upon orifice 142 and the pilot port 109 at the top end of spool valve 102. This forces valve 102 to shift to direct the pressure $P_2$ in line 134 to tank. Therefore pilot pressure in line 134 is zero and four-way valve 100 connects high pressure flow into main cylinder port 73. When this occurs piston 42 moves toward its extended position. As it initially moves outward, the connection between ports 70' and 72 is broken as groove 67 moves away and no pressure flow is then present in line 138. Orifice 142 vents the line 138 to tank and the conventional bias spring force holds spool valve 102 in the state where control port 103 directs pressure $P_2$ in line 134 to tank. Of course valve 100 remains in the position directing flow to cylinder port 73.

As piston 42 moves through its outward stroke, it delivers power through rod end 52 proportional to the flow and pressure delivered to port 73 in a conventional hydraulic context, that is, a power piston delivering force and velocity to do useful work.

When piston 42 reaches its fully extended position, groove 66 becomes aligned with and communicates pilot pressure port 70 with pilot signal port 68. The pilot pressure present at port 70 is then communicated to line 140 which is connected to pilot port 111 at the bottom end of spool valve 102 and to line 134 through orifice 144. As earlier mentioned, initially orifice 144 prevents the pilot pressure from shorting directly to tank through line 145, control port 103 and return port 107 and allows essentially the full pilot pressure to operate on the bottom end of the spool of valve 100 to shift the spool to its second state connecting inlet pressure port 105 to control port 103.

As the spool of valve 102 shifts to this second state, it forces flow through pilot port 109 and orifice 142 to tank. Orifice 142 functions as a damping orifice in this mode offering a small resistance to the shifting of the valve spool.

As earlier described, a selected pilot pressure PP is generated through the action of valve 92 and is communicated through line 146 to spool valve 102 and to pilot pressure ports 70 and 70' via line 148.

Therefore when the pilot pressure signal PP is generated in line 140, this pressure causes spool valve 102 to shift against the force of its bias spring and connects pilot pressure PP to line 134. In this condition, pressure $P_2$ is then equal to pilot to pressure PP. This pilot pressure in line 134 operates to shift valve 100 to connect cylinder port 73 to tank and cylinder port 75 to high pressure to reverse the stroke of piston 42.

However, at the same time that spool valve 102 moves to the position connecting pilot pressure PP through ports 105 and 103 to line 134, this same pilot pressure PP is connected through orifice 144 and lines 150 and 153, locks in at pilot port 111 at the bottom end of spool valve 102 to hold it open even when piston 42 moves to disconnect line 140 from pilot control port 68. Now the same pilot pressure PP which is delivered by line 140 is also present at the bottom end of the spool valve 102 via lines 147, 150 and 155. This holds valve 102 in the same state and pressure $P_2$ is at the same value as pilot pressure PP to operate valve 100 to switch to deliver pressure flow to cylinder port 75.

As piston 42 reverses its stroke and breaks the connection between pilot pressure port 70 and port 68 no further flow occurs through line 140. However, valve 102 is still held open by its own pilot pressure PP as described above to continue to deliver pilot pressure PP to line 134 and to the bottom end of four-way valve 100 until another signal pressure pulse is actuated through control port 68. This will occur when piston 42 reaches its retracted position and ports 70' and 72 are communicated via groove 67 as previously described. When this occurs, another pilot signal pulse pressure PP is communicated to pilot port 109 at the top end of spool valve 102. This pilot pressure plus the bias spring in the valve 102 force the spool in valve 102 to bleed flow through orifice 144 or a one way check valve 152 to allow the spool to begin to shift to the opposite position.

Before spool valve 102 can move to its position which vents the pressure in line 134 down to tank pressure, it must go through an intermediate blocked condition which occurs when ports 105, 103 and 107 are not open. At this moment, the pressure present in line 134 is the same as the pilot pressure PP at pilot port 109 at the top end of spool valve 102. This pilot pressure plus the force of bias spring is greater than the pilot pressure PP alone in lines 150, 153 and 155. Check poppet valve 152 is set to be forced open, which allows spool valve 102 to continue to shift to its opposite position.

At the moment spool valve 102 shifts to open line 134 to tank, there is a sudden drop in pressure in line 134. The bias spring pressure on the top end of valve 102 will then hold valve 102 in the state holding inlet pressure port 105 closed until another pilot pressure pulse is delivered via pilot control port 72 as previously described.

The function of poppet valve 152 is to assure that reversing valve 102 will not become blocked during the transit of the spool valve when no operative valve ports are open and flow through pilot valves 109 and 111 would stop thereby blocking spool travel. In view of the forgoing description, it should be apparent that reversing valve 102 is reliably shifted by the signal pressure pulse delivered by pilot ports 68 or 72 at each end of the piston stroke and will stay or be locked in the shifted state until pulsed into the reverse mode.

It should be understood that the pilot pressure PP may be supplied from the system pressure via the action of reducing valve 92 or may be supplied from a separate low pressure source. A typical order of magnitude for the pilot pressure may be about 150 psi, for example. The bias springs in valves 100 and 102 would then be in the order of about 50 psi to perform the functions described in a practical manner, although other practical magnitudes could be used.

The term pressure pulse signal as used herein relative to the pressure signal generated by the action of piston 42 moving to open or close communication between plot ports 68, 70, 70' and 72 is meant in the context as transient or not continuous relative to valve 102. However, it should be understood that the pressure signal generated when grooves 66 and 67 are aligned to communicate the respective pilot pressure and control ports with one another will be present until the piston reverses its stroke pursuant to valve 100 being shifted. The reversal movement of piston 42 will not occur until the appropriate shifting of valve 100 has been completed as described and the zero or full pilot pressure condition in line 134 has been established which assures that piston 42 will complete its reverse stroke even after communication of the respective pilot ports 70 or 70' and control ports 68 or 70 has been terminated.

The reversal logic system operates separate from whatever flow and pressure control functions are chosen to control the high pressure supply to cylinder 44. The power piston 42 sees typical high operating pressure at each end to perform work on its extended or retracted stroke. In its central region, isolated from high pressure, it operates as a relatively low pressure pilot spool valve wherein grooves 66 or 67 may communicate with side wall ports such as 68, 70, 70' and 72 at selected piston positions to develop reversing signals to the reversing logic circuit via control valve 102. Of course, the same pilot signals could be generated to other types of control valves to trigger various control functions as may be practical and desired.

In general, the circuit described for conventional control of the power flow through four-way valve 100 includes a two stage flow control supplying a given magnitude of flow to one side of the piston and a different magnitude of flow to the opposite side. The magnitude of the flows can be arranged to provide equal speed of the piston during its extended and retracted strokes or unequal speed as may be desired. It also controls the number of cycles per minute which can be adjusted accordingly.

The circuit shown in FIG. 9 also provides for maximum pressure control which might be termed a safety relief pressure and an active pressure control. The active control could be, for example, related to measuring the pumping action of a pump connected to actuator piston 42. This is illustrated by line 162. Line 160 communicates cylinder port 75 to valves 98 and 96 to assure that valve 96 will close completely upon reversal of piston 42 toward its retracted position.

An active set pressure may be connected to line 162 which in conjunction with the pilot pressure signal generated in line 160, to permit valve 98 to act as a relief valve to prevent the pressure developed on the rod side of piston 42 to go higher than the set pressure, 500 psi for example.

It should be understood that any number of conventional controls of the reciprocating action of piston 42 in the conventional power sense can be applied without departing from the novel aspects described herein.

Figure 8:
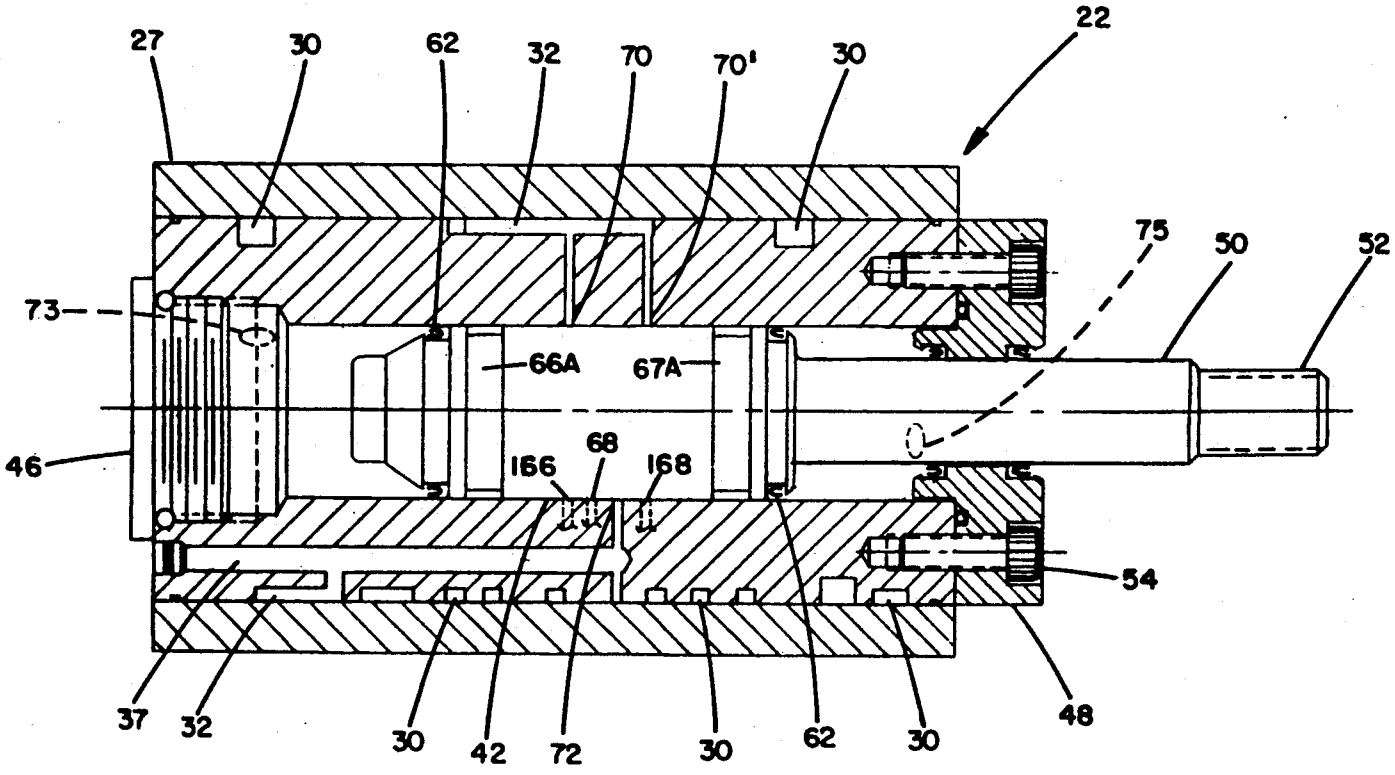
FIG. 8 is a view similar to FIGS. 7 and 8 illustrating a modified embodiment of an apparatus constructed in accordance with the present invention showing additional pilot ports for actuating an additional pilot signal relating to the position of the piston during its stroke.

As another example of employing the piston 42 as a pilot control element, the circuit shown in FIG. 10 is the same as shown in FIG. 9 except for the added control elements which provide a deceleration function to the stroke of piston 42 via appropriate additional cylinder pilot ports 166 and 168. These ports are also shown in FIG. 8 in conjunction with the reversal pilot ports described above herein.

In the example shown, grooves 66-A and 67-A are made wider than grooves 66 and 67, although a separate pair of grooves could also be employed, if one chose to add two more pilot pressure ports such as 70 and 70'.

As seen in FIG. 10, an orifice 170, a bypass valve 172 and a pilot control valve 174 are added in series with the flow control line 90 feeding four-way valve 100. The same circuit elements shown in FIG. 9 carry the same reference numerals in FIG. 10.

In the normally open state as shown, these additional circuit elements offer no significant resistance to the flow through valve 100 and flow occurs in the same manner as previously described. Valve 174 is on the tank side of four-way valve 100 and is shown as a normally closed valve having a feedback line 176 to the pressure port 111 communicating with main cylinder port 73. This can be arranged so that the feedback line communicates with a large pilot piston area in valve 174, therefore even a relatively small pressure at valve port 11 opens valve 174 to dump to tank so that flow will not be impeded.

As piston 42 moves to its extended position, groove 66-A first communicates pilot pressure port 70 to pilot port 166. This pilot pressure is fed to valve 172 via line 178 which is operatively connected to port 166. A control orifice 180 bleeds off a small portion of the flow at high resistance, however, the pilot pressure will cause valve 172 to close. Then all flow from line 90 must go through orifice 170. This causes an increased resistance to the flow to port 111 which forces excess through main bypass valve 94. In turn, flow to cylinder port 73 is decreased proportionally.

At the same time, flow out of port 75 is communicated through valve port 114 of valve 100 to control valve 174.

In general, valve 174 conventionally controls the pressure to the rod end cylinder port 75 to provide a breaking action on any external mass acting on the rod to oppose or aid slowing the mass M on rod 52. This deceleration pressure is brought to port 75 and the rod end of piston 42 when the deceleration circuit elements are actuated by a pilot pressure signal communicated to pilot port 166 via alignment of groove 66-A with pilot pressure port 70. Therefore when pilot pressure from port 70 is communicated to port 166, a pilot pressure signal is sent to actuate the deceleration circuit shown. This results in a breaking pressure being generated on the rod side of piston 42 through port 75 while the flow to the opposing side of piston 42 through port 73 is decreased. This results in a piston 42 can be controlled over a selected distance and energy level which may be calculated conventionally to avoid shock or undue pressure peaks. Such an arrangement is desirable if a large mass is connected to rod 52. Usually in a low mass system, no undue pressure peaks or spikes will be generated at the end of the piston stroke and additional deceleration control is not required.

As shown in FIG. 10, the same reversal action also takes place when grooves 66-A and 67-A move to communicate the pilot pressure ports 70 and 70' and pilot control ports 68 and 72 as previously described. The placement of deceleration pilot ports 166 and 168 ahead of reversal pilot ports 68 and 72 permit these ports to be communicated to pilot pressure prior to communicating the reversal pilot ports to pilot pressure. Therefore piston 42 is caused to decelerate as it approaches the end of its stroke and is reversed as earlier described without undue pressure peaks or spikes shocking the system.

As reversal is triggered, flow to the opposing cylinder port goes through orifice 170 until the respective groove 66-A or 67-A passes its respective pilot port 166 or 168. Then full flow is restored via the opening action of valve 172.

The deceleration circuit described basically acts as a resistance in the line which absorbs the energy generated by the moving mass acting on the piston to bring the piston to rest in an orderly manner prior to reversing the stroke. This circuitry is triggered by the piston acting as a pilot control valve element generating a pilot signal related to the position of the piston during its extended or retracted stroke in a similar manner as in the reversal function and preferably is combined as described herein. However, the deceleration function can be used alone if desired with reversal being accomplished by conventional means.

The pilot signal pressures developed in accordance with the present invention may be used to trigger other fluid power control functions which may be advantageously related to the piston position during its travel in the cylinder. Such pilot signals accurately sense the piston position and eliminate any need for mechanical triggers or switches actually connected to or contacted by the piston such as priorly employed in the prior art. Therefore they provide a solely fluid power system to control the action and operation of a power piston doing its conventional work.

In the embodiment shown, preferably all circuit interconnections between operative fluid power elements are accomplished by a selected pattern of grooves, such as 30 and 32, radial holes, such as 34, and axial passages, such as at 37. Such an arrangement provides significant advantages in manufacturing an efficient, compact and practical package allowing complex circuitry design. However, any other standard and conventional means and methods for accomplishing the necessary circuit interconnections could also be used without departing from the spirit of certain aspects of preferred embodiments described herein.

While certain preferred embodiments of the present invention have been disclosed in detail, it is to be understood that various modifications may be adopted without departing from the spirit of the invention or scope of the following claims.

I claim:

1. A fluid power actuator assembly comprising, in combination, a) a manifold control housing including a cylindrical core member having an outer wall surface and provided with an axially extending cylinder bore, an outer receptacle member having a bore, a plurality of axial and circumferential grooves formed between an outer wall surface of said core and an inner wall surface of said bore in said receptacle member engaging said outer wall surface, said grooves cooperating with a plurality of radial passages to form a fluid circuit interconnecting a plurality of control valves mounted on said receptacle member;

b) a piston means mounted for reciprocation within said cylinder bore formed in said core member and carrying means to seal opposing end chambers of said bore from one another;

c) a pair of cylinder inlet ports disposed in said cylinder bore, a different one of said ports communicating with a different end of said piston means and communicating with a primary reversal control valve in said fluid circuit having two operative positions for alternately communicating a source of driving pressure or atmospheric pressure to at least one of said different ends of said piston to cause reciprocation of said piston in said cylinder bore;

d) a plurality of inlet signal ports and three outlet signal ports disposed in the wall of said cylinder at selected axially spaced positions along the stroke path of said piston, said inlet ports being circumferentially spaced from said outlet signal ports and in continuous communication with a fluid signal pressure independent of the position of said primary reversal control valve; and e) a plurality of circumferential grooves disposed in a predetermined axially spaced position on said piston for communicating said inlet signal ports to said outlet signal ports when one of said grooves is axially aligned between an inlet and outlet signal port during travel of said piston along its stroke path to communicate fluid signal pressures to said three outlet signal ports; two of said outlet signal ports operatively connected to a first fluid actuated control element different than said primary reversal control valve to cause alternating reversal of said piston stroke and said third outlet signal port operatively communicated to a second fluid actuated control element different than said primary reversal control valve to actuate a control function in said fluid circuit different than reversal of said piston stroke.

2. The actuator assembly defined in claim 1 including a fourth outlet signal port in said cylinder bore axially spaced from said three outlet signal ports and circumferentially spaced from said inlet signal ports, said fourth outlet port being communicated to one of said inlet ports when one of said grooves is aligned with said inlet signal port and said fourth outlet signal port to generate a fluid pressure signal for actuating a control function different than reversal of said piston stroke.

3. An actuator assembly comprising in combination, a piston slideably mounted in a cylinder bore, and including a rod end for operative coupling to a working element, an inlet port disposed in said cylinder bore at each opposing end of said piston, each of said inlet ports being operatively connected to a conventional supply of fluid driving pressure directly through a reversal control valve having at least two operative positions for causing reciprocation of said piston in said cylinder bore; a plurality of inlet signal ports and three outlet signal ports disposed in the wall of said cylinder at selected axially spaced positions along the stroke path of said piston, said inlet signal ports being circumferentially spaced from said outlet signal ports and in continuous communication with a fluid signal pressure independent of the position of said primary reversal control valve; and a plurality of circumferential grooves disposed in a predetermined axially spaced position on said piston for communicating said inlet signal ports to said circumferentially spaced outlet signal ports when one of said grooves is axially aligned with an inlet and outlet signal port during travel of said piston along its stroke path to communicate fluid signal pressures to each of said three outlet signal ports; two of said outlet signal ports operatively connected to a first fluid actuated control element different than said reversal control valve to cause alternating reversal of said piston stroke and said third outlet signal port operatively connected to a second fluid actuated control element different than said reversal control valve to actuate a control function in said fluid circuit different than reversal of said piston stroke.

4. The actuator assembly defined in claim 3 including a fourth outlet signal port in said cylinder bore axially spaced from said three outlet signal ports and circumferentially spaced from said inlet signal ports, said fourth outlet port being communicated to one of said inlet ports when one of said grooves is aligned with said inlet signal port and said fourth outlet signal port to generate a fluid pressure signal for actuating a control function different than reversal of said piston stroke.

5. The actuator assembly defined in claim 3 wherein at least one of said grooves axially disposed along the length of said piston sequentially communicates at least two different outlet signal ports with at least one inlet signal port during travel of said piston in at least one direction.

* * * * *